US005912864A

United States Patent [19]

Maurer

[11] Patent Number: 5,912,864

[45] Date of Patent: Jun. 15, 1999

[54] SELF CONTAINED FLIGHT DURATION MEASUREMENT AND RECORDING APPARATUS

[76] Inventor: Gregory C. Maurer, 46 New Haven Rd., Vergennes, Vt. 05491

[21] Appl. No.: 08/841,906

[22] Filed: Apr. 17, 1997

[51] Int. Cl.[6] ..... G04B 47/00; G04F 8/00; A63B 57/00; A63B 37/00

[52] U.S. Cl. ..... 368/10; 368/110; 473/200; 473/570

[58] Field of Search ..... 368/3, 10–12, 368/110–113, 278; 273/25, 183.1, 55, 60, 200, 570; 364/565; 377/5, 20

[56] References Cited

U.S. PATENT DOCUMENTS 4,775,948 10/1988 Dail et al. ..... 364/565
5,526,326 6/1996 Fekete et al. ..... 368/10

*Primary Examiner*—Vit Miska
*Attorney, Agent, or Firm*—Thomas N. Neiman

[57] ABSTRACT

The self contained flight duration measurement and recording apparatus is designed to be affixed to or contained within an object that will experience a duration of flight. The apparatus will measure and display the elapsed time of the object's flight. A timing device is positioned in a housing. The timing device is activated by acceleration forces on the object and deactivated by the deceleration forces acting upon the object. The force sensing unit that controls the time is an electrical switch that closes momentarily when subjected to inertial changes. The switch has a central core surrounded by a coil, both of which are integrated into a circuit. As the device experiences acceleration or deceleration, the core will contact the coil which will turn on or turn off the timer. Switch sensitivity can be adjusted as necessary for the specific purposes of the device.

6 Claims, 2 Drawing Sheets

SELF CONTAINED FLIGHT DURATION MEASUREMENT AND RECORDING APPARATUS

BACKGROUND OF THE INVENTION

This invention pertains to timing devices and, in particular, to a self contained flight duration measurement and recording apparatus for use with thrown objects in order to provide a measurement of the elapsed flight time of the object either as a stand alone unit or as an added on or built in unit in a ball, or other thrown object.

The duration of the flight time of a thrown object can be of interest to the participant for training purposes and for competition either against one's personal best or against the performance of others. Currently, measuring approximate flight time can be accomplished by manually starting a stop watch when one initiates the throw and then stopping the watch when the object makes first contact with the ground or some other object. This requires a great deal of precision by the individual operating the stopwatch or requires the individual throwing the object to perform a number of steps at the same time. Both judgment and reaction time can effect the accuracy of the readings.

There have been a number of attempts to measure reaction time and the like. Examples or these devices include the U.S. Pat. No. 4,534,557 issued to Bigelow et al. on Aug. 13, 1985 for a Reaction Time and Applied Force Feedback which shows an extremely complicated unit and the U.S. Pat. No. 5,526,326 issued to Fekete et al. on Jun. 11, 1996 for a Speed Indicating Ball. These devices (do provide some sort of measurement in one way or another, but they do not provide the user the specific elapsed flight time reading in a simple and direct manner.

What is needed is a self contained flight duration measurement and recording apparatus that can be attached to or be built into a thrown object and the can sense inertial changes associated with launching and landing of a thrown object to start and stop a timing mechanism in order to measure and display the elapsed flight time.

It is the object of this invention to teach a self contained flight duration measurement and recording apparatus which avoids the disadvantages and limitations, recited above in previous measurement devices. Another object of this invention is to provide an apparatus that is cost effective, can be provided integrally in the thrown object that can be easy to install and use and, at the same time, be safe, accurate and effective.

SUMMARY OF THE INVENTION

Particularly, it is the object of this invention to teach a self contained flight duration measurement and recording apparatus, for use in providing information regarding the elapsed flight time of a thrown object, said structure comprising a structure comprising a housing for the positioning of said apparatus within said thrown object which the elapsed time will be measured thereon; a force sensing system positioned within said housing; a timing unit positioned within said housing for determining the elapsed flight time of said thrown object; a circuitry system positioned within said housing connecting said force sensing means with said timing unit; and a display unit for showing the elapsed flight time of said thrown object.

BRIEF DESCRIPTION OF THE DRAWINGS

Further objects and features of this invention will become more apparent by reference to the following description taken in conjunction with the following figures, in which.

DETAILED DESCRIPTION OF THE PREFERRED EMBODIMENT

Figure 1:
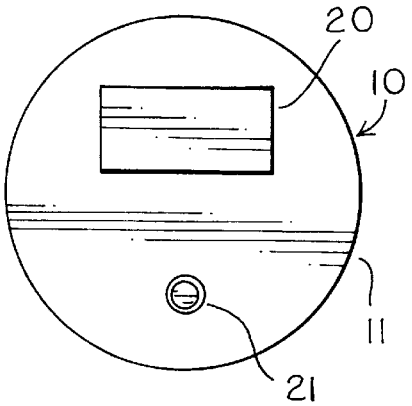
FIG. 1 is a front elevational view of the novel self contained flight duration measurement and recording apparatus.
Figure 2:
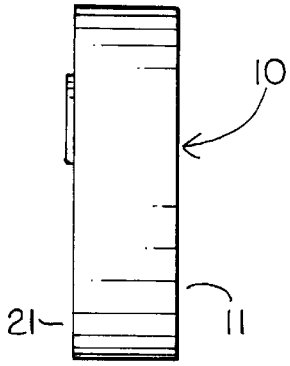
FIG. 2 is a side elevational view thereof.
Figure 3:
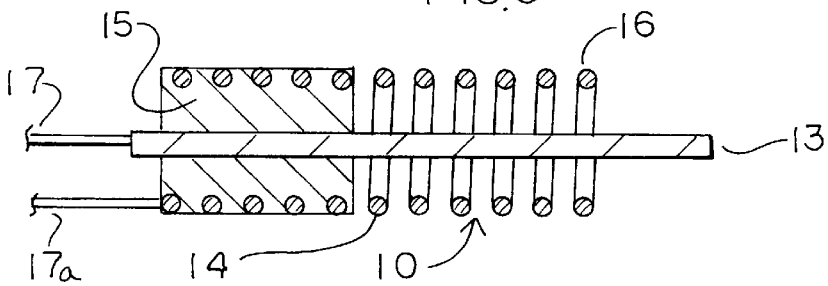
FIG. 3 is an enlarged side elevational view of the force sensing system of the self contained flight duration measurement and recording apparatus.
Figure 4:
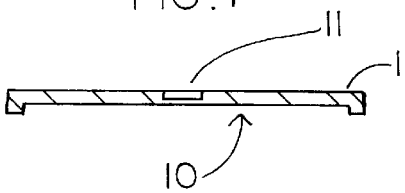
FIG. 4 is a cross sectional view taken along line 4—4 of FIG. 3.
Figure 5:
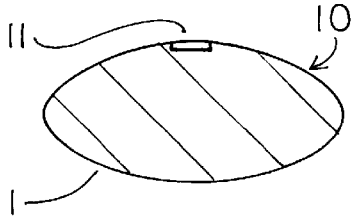
FIG. 5 is a cross-sectional view of the apparatus the device in position in a thrown object.
Figure 6:
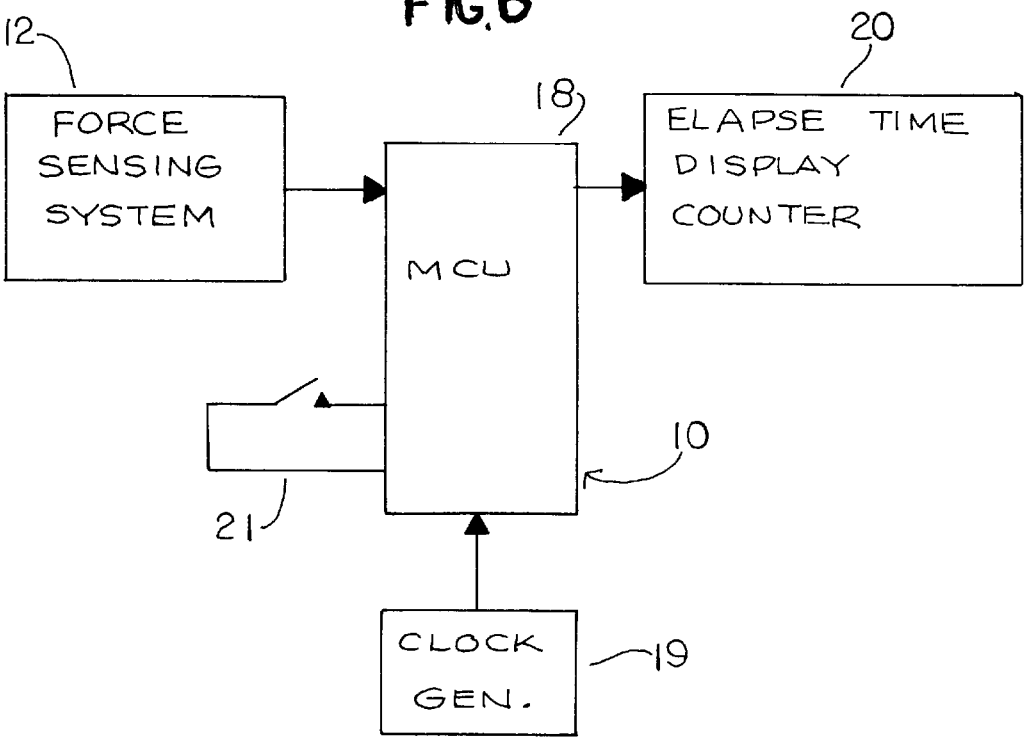
FIG. 6 is an electrical block diagram of the electrical system of the apparatus.

As shown in the figures, the novel self contained flight duration measurement and recording apparatus 10 comprises a housing 11 that contains a force sensing system 12. The force sensing system 12 is comprised of a central core 13 that is rigid and is electrically conductive and a flexible coil or spring 14 that is also electrically conductive and is suspended around the central core 13. The flexible coil 14 is held in position by a non conductive bonding element 15 at one end of the coil 14. The free end 16 of the coil 14 is able to sway in all directions such that when there is a change in the inertia of the object 1 or 2 that the apparatus 10 is imbedded, the coil 14 will come into contact with the central core 12. A number of other designs could be employed to measure the inertia of the thrown object. Each of the components is connected to electrical leads 17 and 17*a* that connect the coil 14 and the core 13 to the main circuitry. The sensitivity of the force sensing system 12 depends upon how easily the coil 14 comes into contact with the core 13. This can be control led by a combination of factors including the diameter of the core, the stiffness and diameter of the coil and tie length and number of coils in the flexible unit.

The electronics incorporated into the system is comprised of the force sensing system 12, the measurement and control circuitry 18, the clock generator 19, the elapsed time counter and display element 20. A push button reset switch 21 is added to the apparatus to zero out the system and is recessed with the housing to avoid accidental closure during flight. Circuit boards contain the measurement and control circuitry, the clock generator, a battery holder, the elapsed time counter and display element. The housing 11 holds the circuit boards, the force sensing system 12 and the display element and is positioned within the thrown object as necessitated by the construction of the particular thrown object.

The measurement and control circuitry 18 samples the force sensing system 12 for any start and stop signals and activates or deactivates the elapsed time counter 20 as necessary. The control sequence is activated (reset state) by the user depressing the reset switch 21. The measurement and control circuitry 18 clears the counter and display 20 and waits for a start signal from the force sensing system 12. Upon being activated by the force sensing system 12, the measurement and control circuitry generates a start count signal to the elapsed time counter 20 (count state). The measurement and control circuitry 18 then awaits a stop signal from the force sensing system 12. When it receives it, a stop count signal is sent to the elapsed time counter 20 (latch display state) and the elapsed time is displayed by the display element 20. The time can be displayed in units of seconds, tenths of seconds and hundreds of seconds. The measurement and control circuitry 18 is then standing by for a reset signal from the reset switch 21. The elapsed time counter 20 is measuring the time from the clock generator 19 which is a free running stable oscillator. The display 20 is a digital readout that are visible though a cut out in the side of the housing 11.

The specific construction is dependent upon the specific application of the thrown object. In general, the display is positioned into the housing with the digital readout visible through the cut out in the housing. Elastometric connector strips are placed over the displays contacts. The circuit boards use alignment pins, soldering and screws to position the circuits in the housing. A cover is placed over the display unit of the housing and secured by screws.

While I have described my invention in connection with specific embodiments thereof, it is clearly to be understood that this is done only by way of example and not as a limitation to the scope of my invention as set forth in the objects thereof and in the appended claims.

I claim:

1. A self contained flight duration measurement and recording apparatus, for use in providing information regarding the elapsed flight time of a thrown object, said apparatus comprising:

a structure comprising a housing for the positioning of said apparatus within said thrown object which the elapsed time will be measured thereon;

said housing comprising a construction of a protective material;

a force sensing system positioned with said housing for determining changes in inertia upon said thrown object;

said force sensing system comprising first means and second means positioned within said protective housing, said first means comprising an electrically conductive core element and said second means comprising a electrically conductive flexible unit surrounding said electrically conductive core element;

said electrically conductive flexible unit comprising an adjustably flexible metallic coil positioned around said electrically conductive core element;

said electrically conductive flexible unit having a base element located at one end of said electrically conductive flexible unit for permitting said electrically conductive unit to be suspended around said electrically conductive core element;

said base comprising a non-conductive bonding mass for both said electrically conductive core element and said electrically conductive flexible unit are installed therein;

a timing unit positioned within said housing for determining the elapsed flight time of said thrown object;

a circuitry system positioned within said housing connecting said force sensing means with said timing unit; and a display unit for showing the elapsed flight time of said thrown object.

2. A self contained flight duration measurement and recording apparatus, according to claim 1, wherein:

said timing unit of said self contained flight duration measurement and recording apparatus comprises a clock generator for providing a time base for said apparatus; and said clock generator comprises a free running stable oscillator.

3. A self contained flight duration measurement and recording apparatus, according to claim 2, wherein:

said timing unit of said apparatus further comprises a counter positioned within said housing that measures clock soundings from said clock generator.

4. A self contained flight duration measurement and recording apparatus, according to claim 1, wherein:

said circuitry system comprises at least one printed circuit board assembly positioned with said housing;

said printed circuit board having measurement and control circuitry, said timing unit and said display unit;

said printed circuit further having holder means for supporting a power source.

5. A self contained flight duration measurement and recording apparatus, according to claim 2, wherein:

said circuitry system further comprises reset means for resetting said apparatus as desired; and said reset means having a push button resettable unit.

6. A self contained flight duration measurement and recording apparatus, according to claim 1, wherein:

said display unit comprises a digital readout for allowing the user to see the elapsed flight time of the thrown object;

said display unit further comprises a cutout area in the housing for enabling said user to read the elapsed flight time of the thrown object; and said display unit further having a clear covering for ease of viewing of the readout.

* * * * *